US005709006A

United States Patent [19]

Carter, Jr.

[11] Patent Number: 5,709,006

[45] Date of Patent: Jan. 20, 1998

[54] METHOD AND APPARATUS FOR CLEANING WITH A BROOM

[76] Inventor: Harvey R. Carter, Jr., 124 N. Second, Apt. 314, Klamath Falls, Oreg. 97601

[21] Appl. No.: 359,681

[22] Filed: Dec. 19, 1994

[51] Int. Cl.[6] ..... A46B 17/04

[52] U.S. Cl. ..... 15/247; 15/143.1; 15/210.1; 15/227

[58] Field of Search ..... 15/247, 107, 114, 15/227, 210.1, 143.1

[56] References Cited

U.S. PATENT DOCUMENTS

| | | | |
|---|---|---|---|
| 160,567 | 3/1875 | Bronson et al. . | |
| 547,320 | 10/1895 | Barker . | |
| 693,710 | 2/1902 | Hughen . | |
| 1,061,486 | 5/1913 | McDonald . | |
| 1,080,572 | 12/1913 | McDonald . | |
| 1,339,767 | 5/1920 | Kelly | 15/247 |
| 2,293,461 | 8/1942 | Gougeon | 15/247 |
| 2,815,521 | 12/1957 | Winckler | 15/247 |
| 2,963,731 | 12/1960 | Hoots | 15/247 |
| 3,716,885 | 2/1973 | Thompson | 15/247 |
| 4,400,842 | 8/1983 | Vitonis . | |
| 4,945,599 | 8/1990 | Flynn . | |
| 5,205,012 | 4/1993 | Coley . | |

FOREIGN PATENT DOCUMENTS

| | | | |
|---|---|---|---|
| 505277 | 5/1920 | France . | |
| 0678657 | 7/1939 | Germany | 15/247 |
| 2848-816 | 6/1979 | Germany . | |
| 88780 | 3/1937 | Switzerland . | |

*Primary Examiner*—David Scherbel
*Assistant Examiner*—James F. Hook
*Attorney, Agent, or Firm*—William A. Birdwell & Associates

[57] ABSTRACT

A method and apparatus for cleaning with a broom. Attachments to a common household broom comprise a clamp having hooks, a broom-shaped inner cover and a rectangular outer cover. The inner cover is adapted to be placed over the broom bristles and fastened to the broom with elastic straps placed over the respective hooks of the clamp. The inner cover may be selected to be further covered by the outer cover, which is placed thereover and secured thereto by a rubber band.

6 Claims, 5 Drawing Sheets

METHOD AND APPARATUS FOR CLEANING WITH A BROOM

BACKGROUND

This invention relates to attachments for use in cleaning with a broom, particularly with a common household broom.

Household cleaning, though facilitated in modern times many ways, remains a chore. Further, it is a chore of considerable importance, for cleaning is a requirement of good health and, for many, a psychological necessity as well. As a result, cleaning tools and agents comprise a visibly large part of the goods found in the consumer market.

The cleaning art exhibits many variations of cleaning tools, including many variations of the cleaning tools comprising attachments to a standard household broom. Some of these attachments provide a cloth or other absorbent cleaning surface to act as an intermediary between the bristletip substrate of the broom and the material to be cleaned. The bristletip substrate provides a mechanical support for the absorbent surface, the mechanical support having the properties of stiffness and compliance balanced in desirable amounts, as well as providing the desirable property of light weight. Further, household brooms are fitted with a convenient handle allowing extension of the cleaning surface to the object to be cleaned, above or below a comfortable plane from which to work, which permits the user to stand rather than stoop or climb.

Devices adapting a cleaning cloth to a broom are ubiquitous throughout the history of the patent records, indicating a long-felt and unsatisfied need. Such devices provide the readily available broom with increased functionality, to perform, for example, as a mop, a duster and a scrubber; however, opportunities to improve these functionalities and the ease of their employment have gone unrecognized.

The aforementioned devices may be identified with one of two categories. First, there are attachments to a household broom that are adapted to receive a standard cloth, such as a rectangular washcloth. These devices are exemplified by Barker, U.S. Pat. No. 547,320, Hughen, U.S. Pat. No. 693,710; and McDonald, U.S. Pat. No. 1,080,572. Second, there are attachments to a household broom that provide for employment of a specialized cloth, optimized for its intended use. Such devices are exemplified by Soderberg, Swedish Patent No. 88780; German Patent No. 2848816; and Flynn, U.S. Pat. No. 4,945,599.

Devices of the first category, while providing the utility of employing readily available cloths, are limited by the construction of those cloths in providing for the use of other materials which may be superior in specific applications. More importantly, adaptations for attaching standard cloths to a broom must compensate for the fact that standard cloths themselves are not specially adapted for use with a broom. As a result, attachment of such cloths may be mechanically difficult and unreliable in hard use. This is not a consideration having only theoretical importance; these devices depend, for their acceptability, upon providing efficacy or ease of use that well exceeds that available from brooms and cloths alone. Slight differences in the degree of these features provided by these products may well be responsible for large differences in their usefulness.

Devices of the second category are capable of providing a tailored characteristic of cleaning cloth and an increased facility for attaching the cloth to the broom. Yet, these have the drawback that they fail to provide for the interchangeability of cloths provided for by the aforementioned first category devices. They also have not heretofore provided for the greatest degree of ease of application of the cloth to the broom.

SUMMARY

The method and apparatus for cleaning with a broom of the present invention solves the aforementioned problems and meets the aforementioned needs by employing attachments to a common household broom comprising a clamp having one or more hooks, a broom-shaped inner cover and a rectangular outer cover. The inner cover is adapted to be placed over the broom bristles and fastened to the broom with elastic straps placed over the respective hooks of the clamp. The inner cover may be selected to be to be further covered by the outer cover, which is placed thereover and secured thereto by a rubber band.

Therefore, it is a principle object of the present invention to provide a novel and improved method and apparatus for cleaning with a broom.

It is another object of the present invention to provide such a method and apparatus having improved utility, efficacy and ease of use.

It is yet another object of the present invention to provide such a method and apparatus employing an extensible handle.

The foregoing and other objects, features and advantages of the invention will be more readily understood upon consideration of the following detailed description of the invention, taken in conjunction with the accompanying drawings.

DETAILED DESCRIPTION OF A PREFERRED EMBODIMENT

Figure 1:
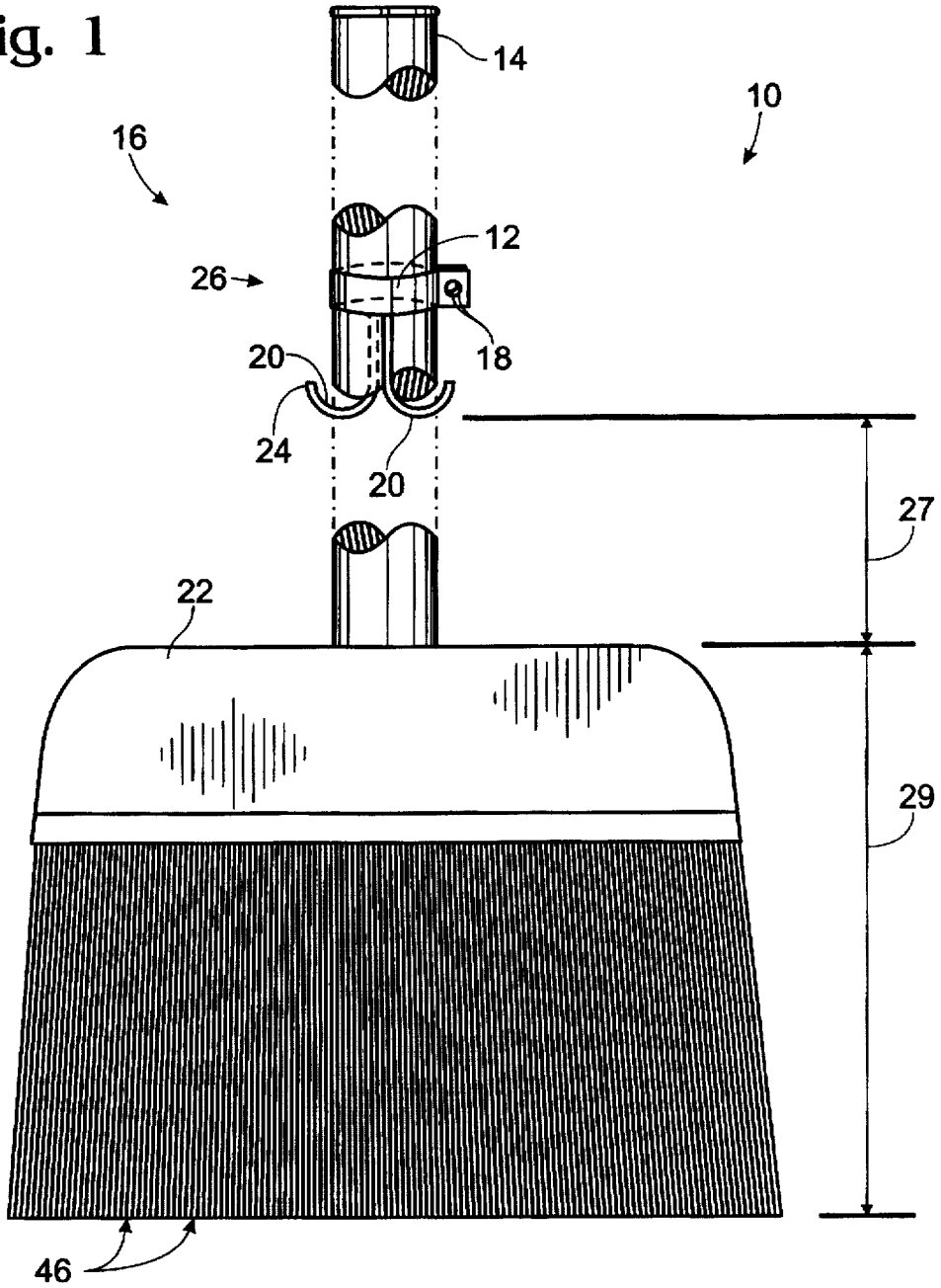
FIG. 1 is an illustration of an exemplary attachment to a broom, with the broom handle shown partially cut away, according to the present invention.

Referring to FIG. 1, a preferred embodiment of an apparatus for cleaning with a broom 10 according to the present invention includes an attachment 12 to a handle 14 of a broom 16.

The attachment 12 preferably attaches circumferentially around the handle 14, by application of a clamping force through the holes 18 applied in any appropriate manner known in the art, such as by a screw, a bolt and nut, a bolt and wingnut, or a clip. Alternatively, a snap, a weld, a bond or friction could be utilized in place of the holes 18 to attach the attachment 12 to the handle 14 without departing from the principles of the invention. As a further alternative, the attachment 12 may be integral to the handle 14.

The attachment 12 includes a pair of hooks 20 extending toward a broom head 22 of the broom 16, and, at a distal end 24 of the hooks, curving or otherwise bending reentrantly. The hooks 20 are preferably integral to the attachment 12.

The hooks 20 are preferably adapted so that their distal ends 24 are fixed at a convenient radial distance from the handle 14 of the broom 16. It has been found that, for a typical broom, a radial distance of about one-half inch is suitable, though other distances might also be used. The attachment 12 should be disposed at a convenient location 26 along an axis of the handle 14 of the broom 16. For a typical broom, it has been found that a distance 27 of about ten inches from the hooks 20 to the broom head 22 is suitable, though other distances might be used. The location 26 of the attachment 12 may be fixed or moveable to other locations without departing from the principles of the invention.

Figure 2B:
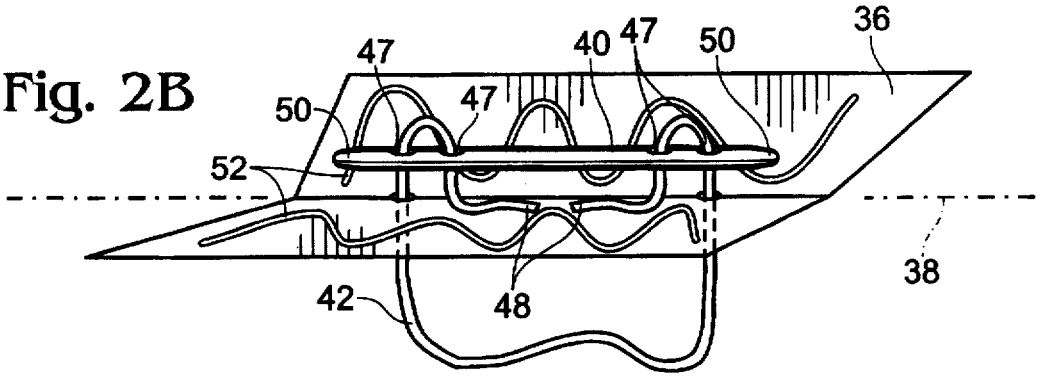
FIG. 2B is an illustration of an attachment strap portion of the exemplary inner cover of FIG. 2A, with a portion of the inner cover cut away.
Figure 2A:
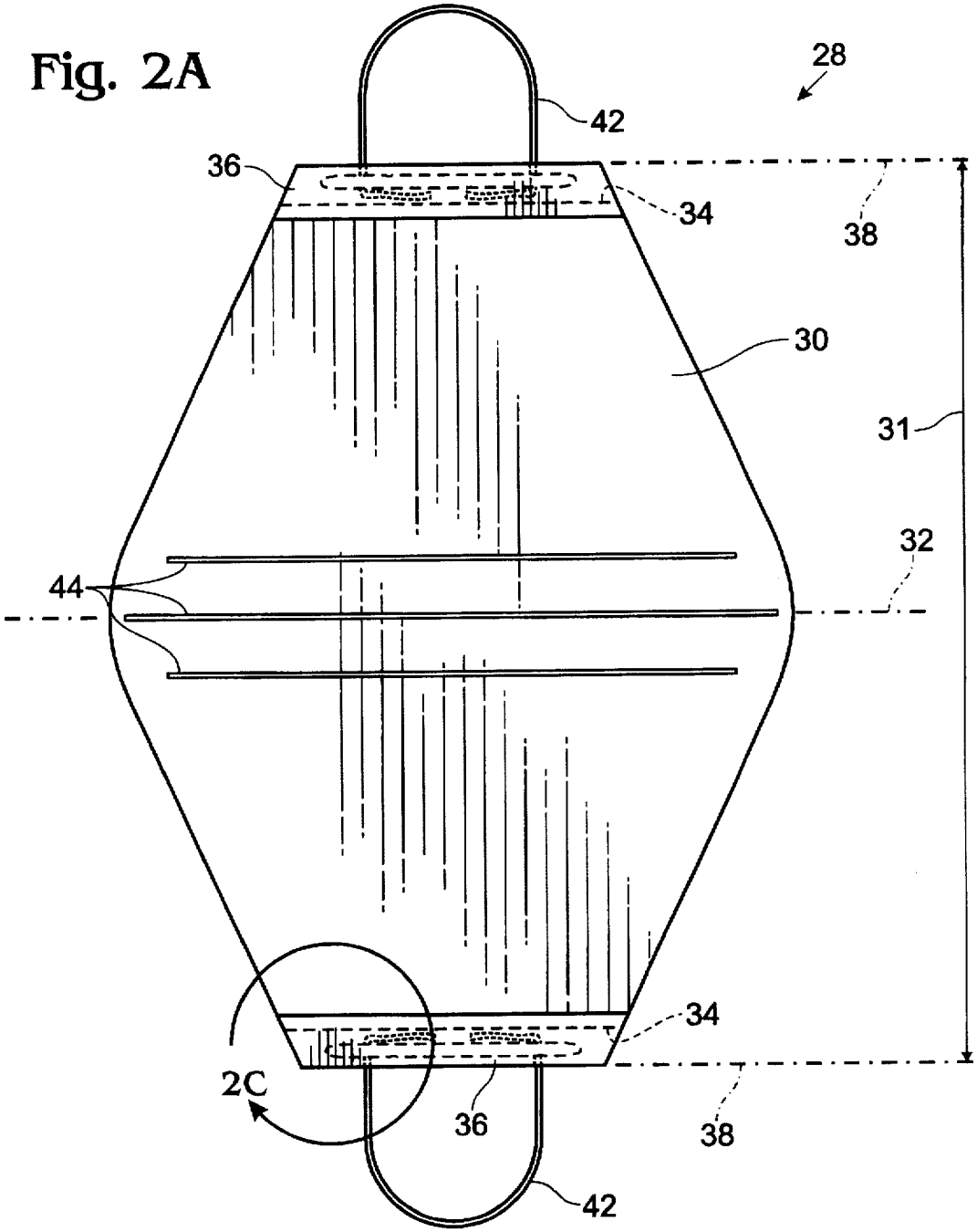
FIG. 2A is an illustration of an exemplary inner cover, according to the present invention.
Figure 2C:
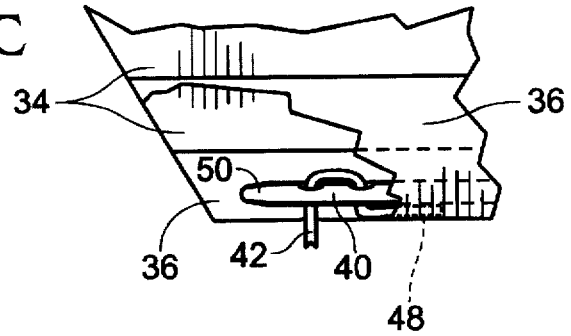
FIG. 2C is an enlarged view of the cut-away portion of the inner cover shown in FIG. 2A.

Referring to FIG. 2A, an inner cover 28 according to the present invention comprises a cloth that preferably, when folded about an axis 32, corresponds to the shape of the head 22 of the broom 16, though it may have a different shape without departing from the principles of the invention. The cloth 30 is preferably terry cloth, however other absorbent or nonabsorbent, flexible or nonflexible materials suited to the cleaning task to which the apparatus 10 is to be put may be used.

The cloth 30, at ends 34, further comprises patches 36 attached thereto, folded at an axis 38, and carrying at their interior, pins 40. Elastic straps 42 are attached to the pins 40. The cloth 30 further comprises registration marks 44 substantially along the axis 32, to correspond to broom bristletips 46. The registration marks facilitate placement of the inner cover 28 onto the broom 16 as will be described more fully below in connection with FIGS. 3A and 3B.

It has been found that, for a broom head 22 having a length 29 of substantially 12 inches, an inner cover 28 having a length of about 24 inches plus the width 45 (FIG. 3B) of the bristle tips 46 is particularly suitable. Further, it has been found that, for the aforementioned dimensions, the unstretched length of the straps 42 from the pins 40 to the furthest point away therefrom is preferably about 16 inches. However, other suitable dimensions may be utilized without departing from the principles of the invention. Referring to FIG. 2B, a patch 36 is shown having a pin 40 located at an apex of a "v" shape to be formed by folding the patch 36 upwardly about the axis 38. The pin 40 has two pairs of holes 46 through which is fed corresponding ends 48 of the elastic strap 42. Pulling the ends through each of the pair of suitably sized holes 46 and leaving a generous length of ends 48, tightens the strap between the holes comprising the pair and holds the strap sufficiently in place to resist tension produced by attaching the straps 42 to respective hooks 24. Preferably the elastic strap 42 has a width of about ⅜ inches and the holes 46 are about 5/16 inches in diameter; however, other combinations of the diameter of the holes 46 and the width of the elastic strap 42 might be employed. It has been found that a particularly suitable strap material is a braided polyester marketed by Rhode Island Textile Company, under the trademark "STRETCHRITE."

For the aforementioned preferred dimensions, each pin 40 is preferably about 9/16 inches in diameter and 5 inches long, and has tapered ends 50. However, the pin 40 may alternatively have other diameters sufficient for the holes 46 and other lengths, without departing from the principles of the invention.

The patch 36 has applied thereto, on a first surface against which the pin 40 rests, an adhesive material 52 for bonding to the cloth 30 at the distal ends 34 thereof and thereby attaching the pin 40 to the inner cover 28. Adhesive material 52 is preferably heat setting, as with an iron; however, other materials capable of bonding the patch 36 to the cloth 30 may be used. The cloth 30 may also be sewn, stapled, clipped or otherwise mechanically attached. A particularly suitable adhesive material is that which is found on a denim patching cloth marketed by Dritz Corp., as "Denim Iron-On Patching Cloth."

Figure 3A:
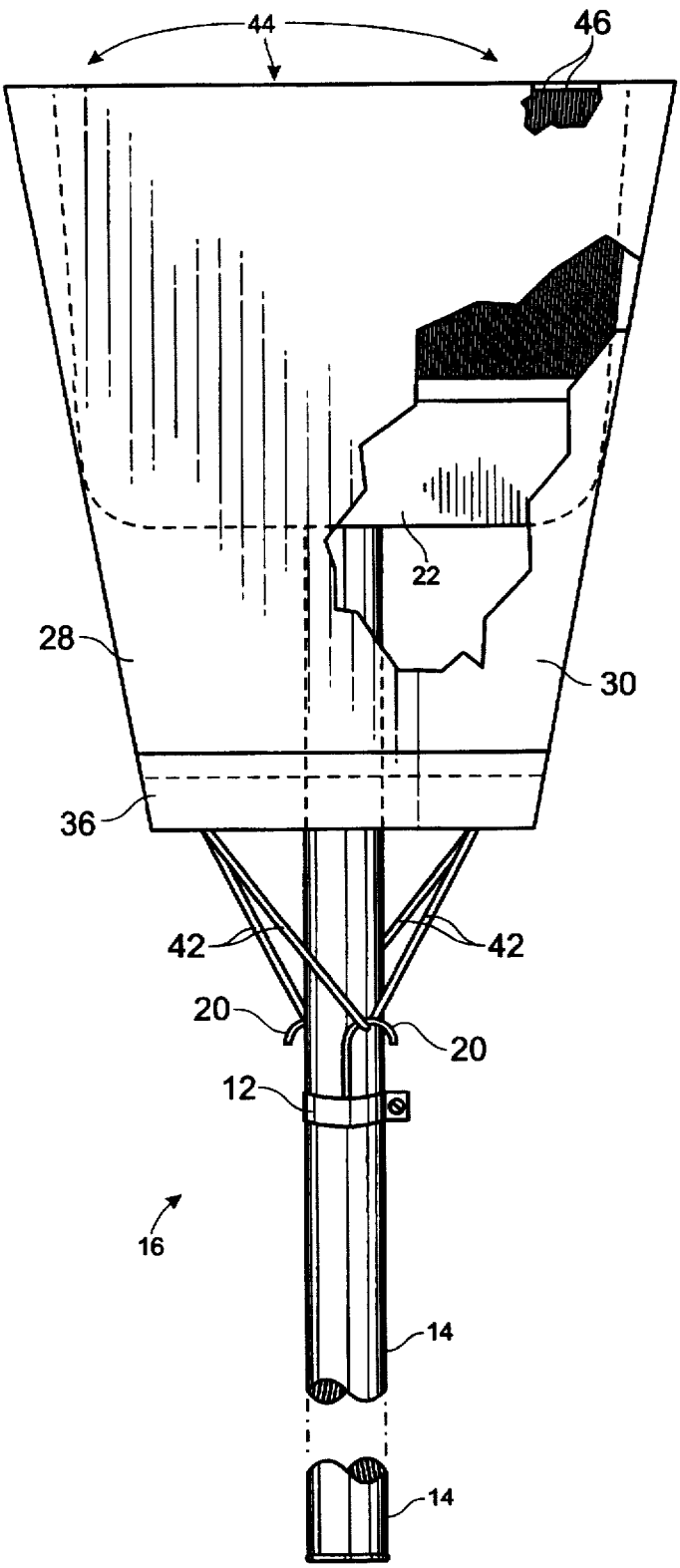
FIG. 3A is a front view of the inner cover of FIG. 2A in cooperation with the attachment of FIG. 1.
Figure 3B:
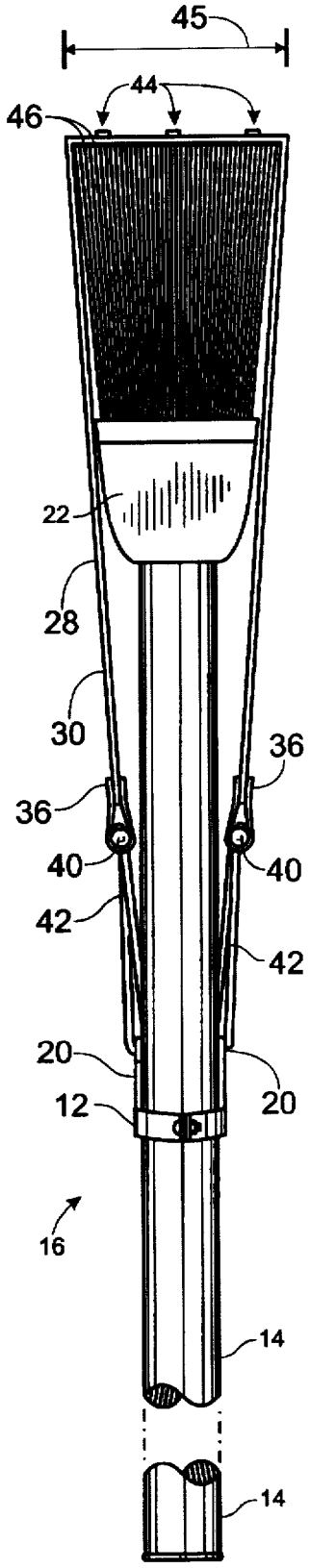
FIG. 3B is a side view of the inner cover of FIG. 3A.

Referring to FIGS. 3A and 3B, the inner cover 28 is shown attached, via the elastic straps 42, to the broom 16, at the hooks 20 of the attachment 12. The elastic straps 42 pull tautly against the pins 40, supported by the folded patches 36 which are attached to the cloth 30 of the inner cover 28, the cloth 30 surrounding and pulling against the bristle-tips 46 of the head 22 of the broom 16. The registration marks 44 aid in placement of the cloth 30 of the inner cover 28 in an optimum location with respect to the bristletips 46.

Figure 4A:
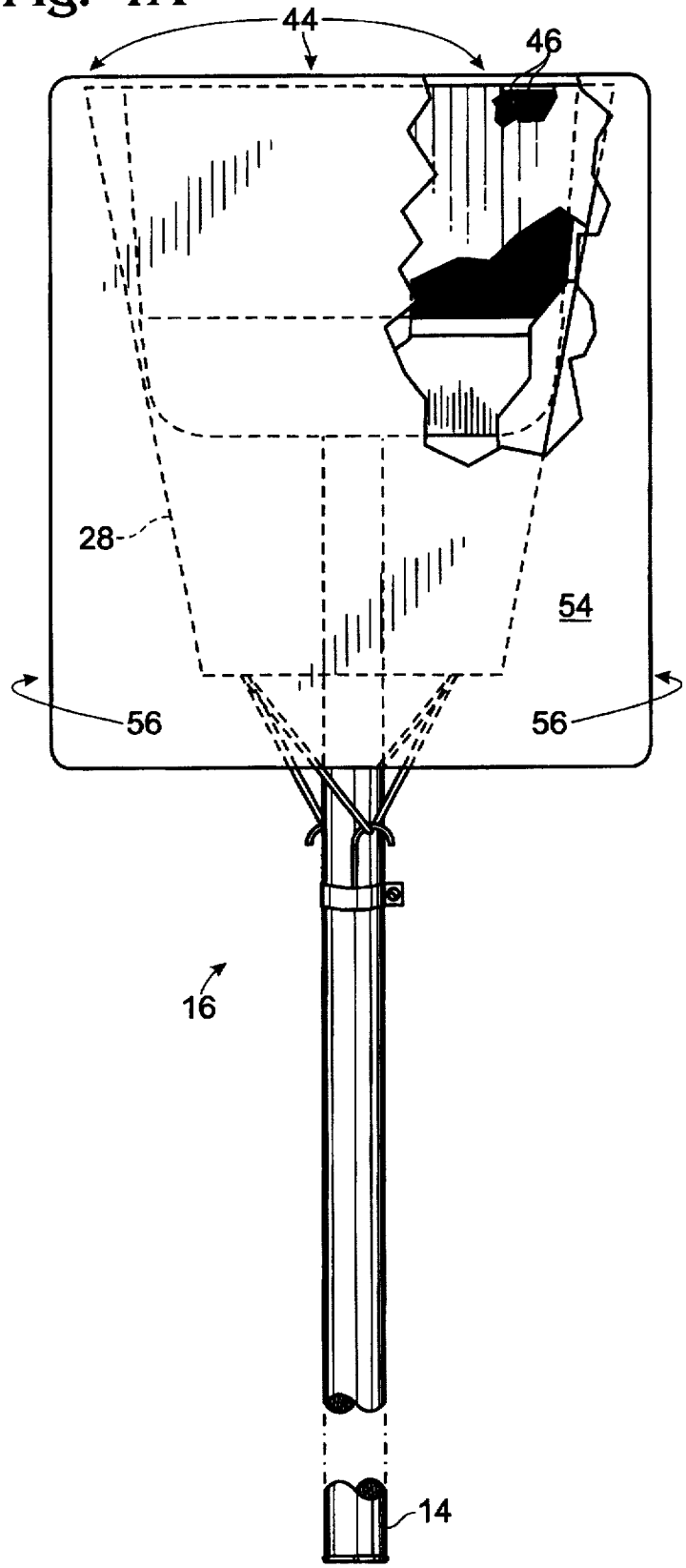
FIG. 4A is a front view of an exemplary outer cover in a first stage of attachment to the inner cover of FIG. 2A according to the present invention.
Figure 4B:
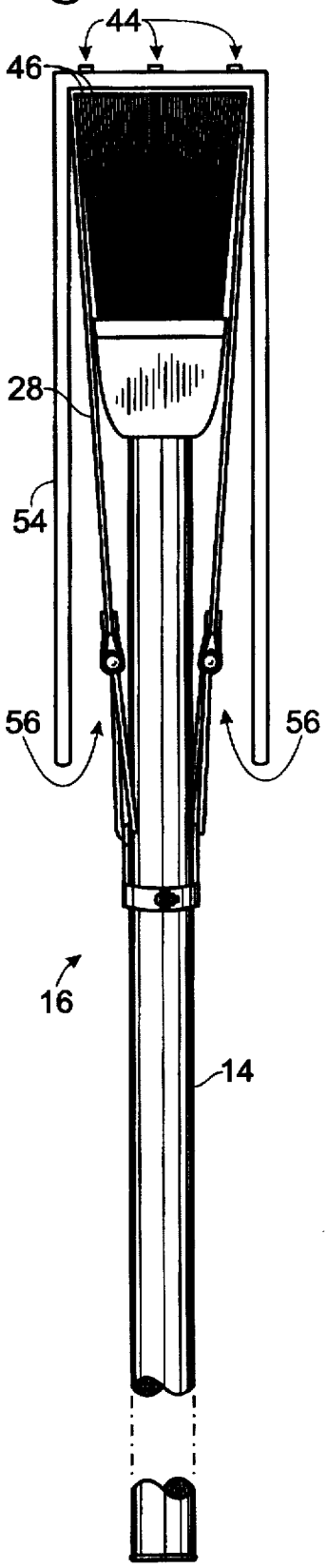
FIG. 4B is a side view of the exemplary outer cover of FIG. 4A.

Referring to FIGS. 4A and 4B, an outer cover 54 is shown in a first stage of attachment to the broom 16 and to the inner cover 28 lying underneath, which separates the outer cover 54 from the bristletips 46. The outer cover 54 is preferably a rectangular standard terry washcloth, though it may incorporate advantageously registration marks 44 similar to the registration marks 44 of the inner cover 28 discussed immediately above, for aiding placement of the outer cover 54 on the broom 16 by aligning the outer cover 54 with the bristletips 46. The outer cover is to be folded onto the inner cover 28 in a manner described below, in connection with FIGS. 5A and 5B, in the direction indicated at 56.

Figure 5A:
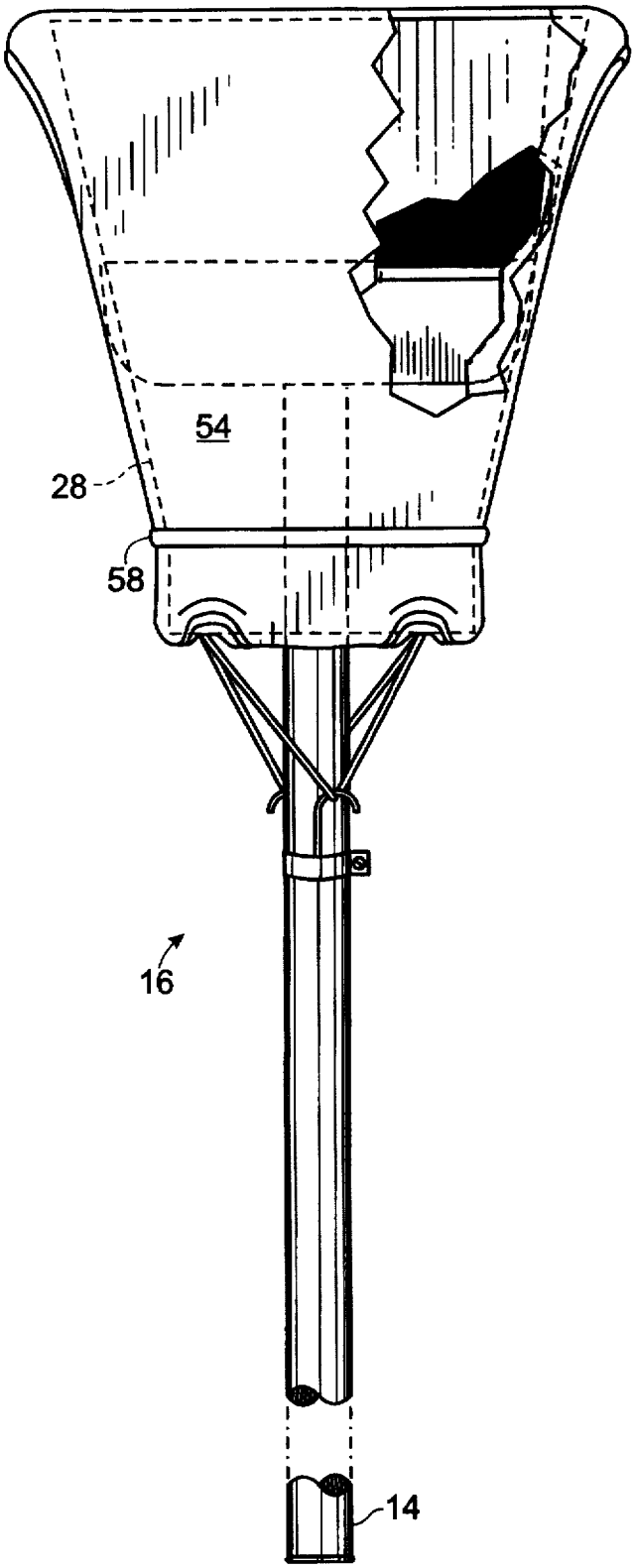
FIG. 5A is a front view of the outer cover of FIG. 4A in cooperation with the inner cover of FIG. 2A.
Figure 5B:
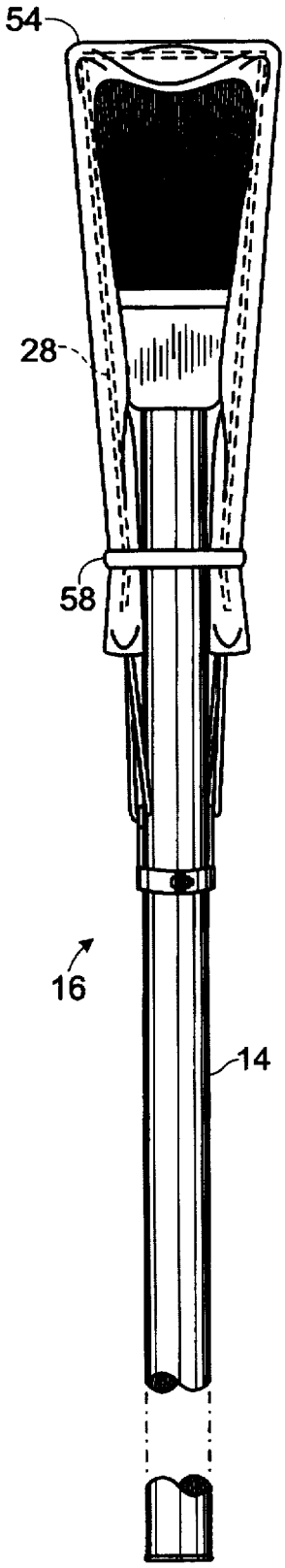
FIG. 5B is a side view of the outer cover and inner cover of FIG. 5A.

Turning to FIGS. 5A and 5B, the outer cover 54 is shown in a second stage of attachment to the broom 16. Portions of the outer cover 54 extending beyond the inner cover 28 are folded therebehind, and the folded outer cover 54 is additionally secured to the inner cover 28 and therefore to the broom 16 by application of an elastic band 56 having a suitable diameter. Preferably the elastic band 56 is a size 33 rubber band, such as, for example, those marketed by United Stationers Supply Co. under the trademark "UNIVERSAL OFFICE PRODUCTS."

The cleaning broom 10 with the inner cover 28 attached is used for dusting, mopping and sweeping areas desired to be cleaned, especially areas that are difficult to access found in the home, office, garage, yard, car, boat or any other indoor, covered or outdoor surface. The cleaning broom is otherwise operated in the same manner as is any standard broom. The cleaning broom is preferably provided with an extensible handle 14 for reaching advantageously specific heights or depths.

The cleaning broom 10 with the outer cover 54 attached provides an increased absorbency and compliancy at the cleaning surface, allows for the attachment of standard cloths, and prolongs the time necessary between changes of the inner cover 28.

We claim:

1. An apparatus for cleaning with a broom, comprising:

an attachment having at least one hook and being adapted for attachment to the handle of a broom;

a first cover having two opposite ends and being adapted to be placed over the bristles of the broom;

a pair of elongate end pieces, affixed to said cover at respective ends thereof, so as to spread said cover over the bristles of the broom; and a pair of elastic straps, each connected at one point to a respective end of said first cover and adapted to be connected at another point thereof to a hook of said attachment, wherein each of said elongate end pieces comprises a substantially rigid pin having two opposite ends and being disposed along a respective end of said first cover, wherein each of said elastic straps is attached to said pin, wherein said elastic strap comprises an elongate elastic member connected at each end thereof to one end of said first cover at spaced apart locations so as to form a loop for placement over one said hook, each end of said elongate elastic member being further connected to each end of a respective pin, said ends of said pin coinciding with said spaced apart locations of said end of said first cover, and wherein said pin has a plurality of holes therethrough, each end of said elongate elastic member being disposed through at least one said hole.

2. The apparatus of claim 1, wherein each end of said elongate elastic member is disposed through at least two said holes.

3. The apparatus of claim 1, further comprising an adhesive patch disposed over one end of said first cover for securing said pin to said first cover.

4. An apparatus for cleaning with a broom, comprising:

an attachment having at least one hook and being adapted for attachment to the handle of a broom;

a first cover having two opposite ends and being adapted to be placed over the bristles of the broom;

a pair of elongate end pieces, affixed to said cover at respective ends thereof, so as to spread said cover over the bristles of the broom; and a pair of elastic straps, each connected at one point to a respective end of said first cover and adapted to be connected at another point thereof to a hook of said attachment, wherein each of said elongate end pieces comprises a substantially rigid pin having two opposite ends and being disposed along a respective end of said first cover, wherein each of said elastic straps is attached to said pin, and wherein said pin is connected to said first cover by an adhesive patch.

5. An apparatus for cleaning with a broom, comprising:

a cover having two opposite ends and being adapted to be placed over the bristles of the broom;

a pair of elongate end pieces, affixed to said cover at respective ends thereof, so as to spread said cover over the bristles of the broom; and a connection mechanism, attached to the broom, to engageably connect said cover to the broom, wherein each of said elongate end pieces comprises:

a pin disposed along a respective end of said first cover; and an adhesive patch affixed to said end of said first cover and said pin so as to encase said end of said first cover and said pin within said adhesive patch.

6. The apparatus of claim 5, wherein said adhesive patch is made of denim.

* * * * *